US005351352A

United States Patent [19]

Chillemi

[11] Patent Number: 5,351,352

[45] Date of Patent: Oct. 4, 1994

[54] METHOD OF FORMING A SEAMLESS SHOE

[76] Inventor: John Chillemi, 27 Brittany Dr., Middletown, N.Y. 10940

[21] Appl. No.: 161,987

[22] Filed: Dec. 2, 1993

Related U.S. Application Data

[62] Division of Ser. No. 901,106, Jun. 19, 1992, abandoned.

[51] Int. Cl.[5] ..... A43D 21/00

[52] U.S. Cl. ..... 12/146 C; 12/145; 36/49; 36/46.5; 36/55

[58] Field of Search ..... 36/45, 49, 46.5, 47, 36/48, 11, 55; 12/146 C, 142 R, 142 T, 146 R, 146 CK, 145

[56] References Cited

U.S. PATENT DOCUMENTS

| | | | |
|---|---|---|---|
| 126,190 | 4/1872 | Crowe | 36/48 |
| 1,712,634 | 5/1929 | Scott | 36/49 |
| 1,712,635 | 5/1929 | Scott | 36/55 |
| 2,494,617 | 1/1950 | Hogan | 36/48 |
| 3,081,563 | 3/1963 | Dronoff | 36/49 |
| 4,942,678 | 7/1990 | Gumbert | 36/11 |

FOREIGN PATENT DOCUMENTS

| | | | |
|---|---|---|---|
| 565005 | 10/1958 | Belgium | 36/49 |
| 138234 | 2/1902 | Fed. Rep. of Germany | 36/48 |
| 672826 | 2/1939 | Fed. Rep. of Germany | 36/47 |
| 671594 | 12/1929 | France | 36/45 |
| 468343 | 12/1952 | Italy | 36/49 |

OTHER PUBLICATIONS

"A Seamless Stitchdown", undated.

*Primary Examiner*—Paul T. Sewell
*Assistant Examiner*—Thomas P. Hilliard
*Attorney, Agent, or Firm*—Rosen, Dainow & Jacobs

[57] ABSTRACT

A shoe having a seamless exterior upper in contact with a seamless interior liner each fashioned from a single piece of material affixed to a sole and having a heel attached to the sole, the shoe being fashioned that, if an oxford type shoe is desired, the tongue and eyelet sections of the shoe being integrally formed from the single piece of material.

1 Claim, 4 Drawing Sheets

FIG. 9
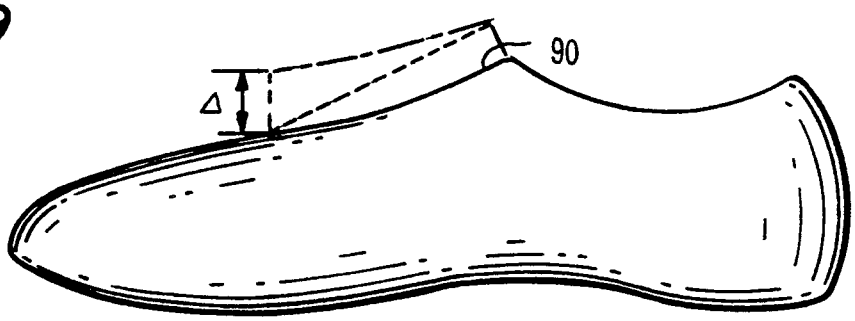
FIG. 10
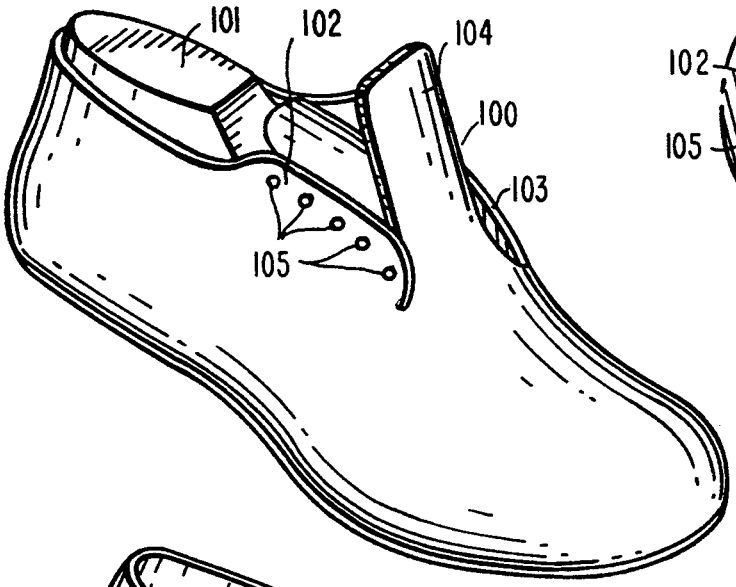
FIG. 10A
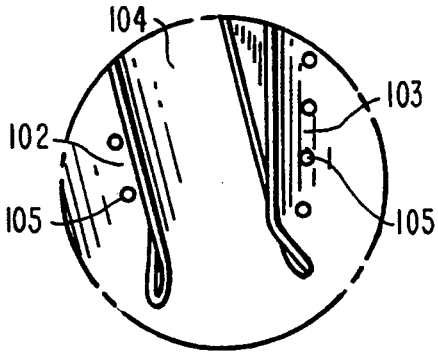
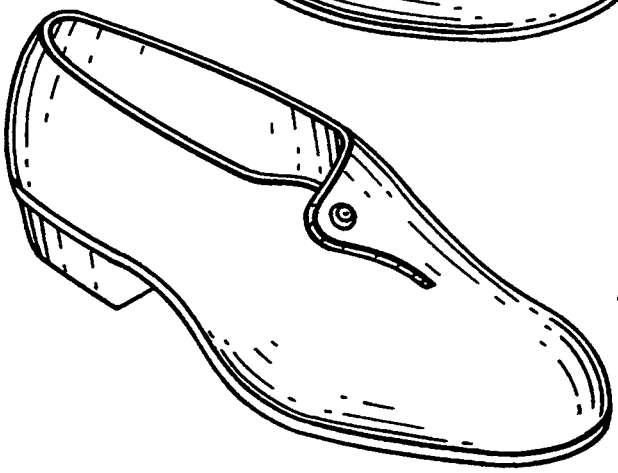
FIG. 11

METHOD OF FORMING A SEAMLESS SHOE

This application is a division of application Ser. No. 07/901,106, filed Jun. 19, 1992, now abandoned.

DESCRIPTION OF THE INVENTION

The present invention relates to footwear, especially shoes, having a seamless exterior upper and a seamless interior liner. The uppers and liners comprising the shoes of the present invention are formed integrally from single pieces of material.

DESCRIPTION OF THE PRIOR ART

Conventionally, the method of shaping ah upper portion of a shoe depends upon the application of force to draw the upper material over the shoe last and fastening it by mechanical means in the stretched condition. The prior art comprises references that disclose a single piece of material used to form the shoe; however, the prior art further discloses that the material when formed into a shoe possesses stitched seams at the connecting joints.

U.S. Pat. No. 114,067 to Tyler and U.S. Pat. No. 877,869 to Schleifer disclose boot uppers made of a single piece of leather. In Schleifer, the single piece of leather is stretched and excess portions are removed to form the shoe upper. In Tyler, a single piece of leather is dampened with moisture and drawn over a last. In these references there is a single seam in the back of the shoe.

U.S. Pat. No. 1,127,037 to Lippiello discloses a shoe made from a single piece of leather. The upper is stretched over a last, as discussed in column 2, lines 64–72.

U.S. Pat. No. 3,309,725 to Staden discloses a method of preshaping shoe uppers. Moisture is applied to the leather to facilitate stretching of the leather. See column 1, lines 45–72 and column 2, lines 20–42.

The present invention unlike the prior art references does not utilize stitching or seams but rather comprises a one piece unit wherein the upper and the liner of the shoe are seamless and without stitching to hold the parts together.

SUMMARY OF THE INVENTION

The present invention comprises a novel method of forming an article of footwear such as a shoe or boot comprising a series of steps.

First a pattern containing the appropriate foot measurements is placed on two pieces of material, the same or different, that are to be used respectively to form a footwear upper and the liner to be situated in the interior of said footwear, adjacent said upper.

The materials are cut to correspond to said measurements. A softening agent is applied to said materials to render them pliable for stretching in the horizontal and vertical planes on a shoe last as the shoe is to be made from a single piece with no seams.

Each said material to be used as said upper, and as said liner respectively, is draped over a separate footwear shoe last, each said shoe last having top and side surfaces comprising a toe portion, a heel portion, an instep portion and a counter portion that extends on both sides of said last from the instep portion along the top of said last to said heel portion and a sole portion that comprises the bottom of said last.

The material is stretched to obtain a tight wrinkle-free surface of the material on the last so that it extends snugly along the top and sides of the surface of said last.

The material is then secured to the bottom where it is secured to said last and excess material is trimmed from the bottom of the last. The material is allowed to set for sufficient time to conform to the shape of the last.

An upper shell is formed by cutting the upper material along the counter portion on each side and a suitable distance down the instep portion to result in the formation of a strip of material suitable for use as a tongue, wherein the two edges adjacent to said strip of material in the instep are suitable to retain eyelets for laces. The material cut out at the top of the last is removed along the counter area to form an opening from instep to heel.

The upper shell is removed from said last and is placed over the liner that has been previously secured to a last. The liner is secured to said upper shell at the location of the collar.

The lining is stitched to said upper shell at the edge of said opening and cut along the edge of the upper shell. The area within the cut is removed so that the opening of said lining corresponds to the opening of said upper shell.

A leather insole is attached to the bottom of said last and the lower edge of said lining is secured onto the bottom of said insole.

A counter is then adhered in the back and a toebox is adhered in the front to the lining. The upper shell is then glued to the toebox, lining and counter.

The bottom edge of said upper shell is adhered to said insole.

A shank is secured on the bottom of said insole toward the heel and the balance of the bottom of said insole is covered with a filler material.

The sole is attached to the bottom of the insole covering the filler and shank and then a heel is thereafter attached.

DESCRIPTION OF THE DRAWINGS

The invention will be described further with reference to the accompanying drawings:

FIG. 9 is a side view of a shoe last showing different slopes in the instep area.

FIG. 10 is a perspective view of the one piece shoe of the present invention.

FIG. 10A is an enlarged front view of shoe depicted in FIG. 10 at the tongue and eyelet area of the shoe.

FIG. 11 is a perspective view of another embodiment of the present invention.

DESCRIPTION OF THE PREFERRED EMBODIMENT

Figure 1:
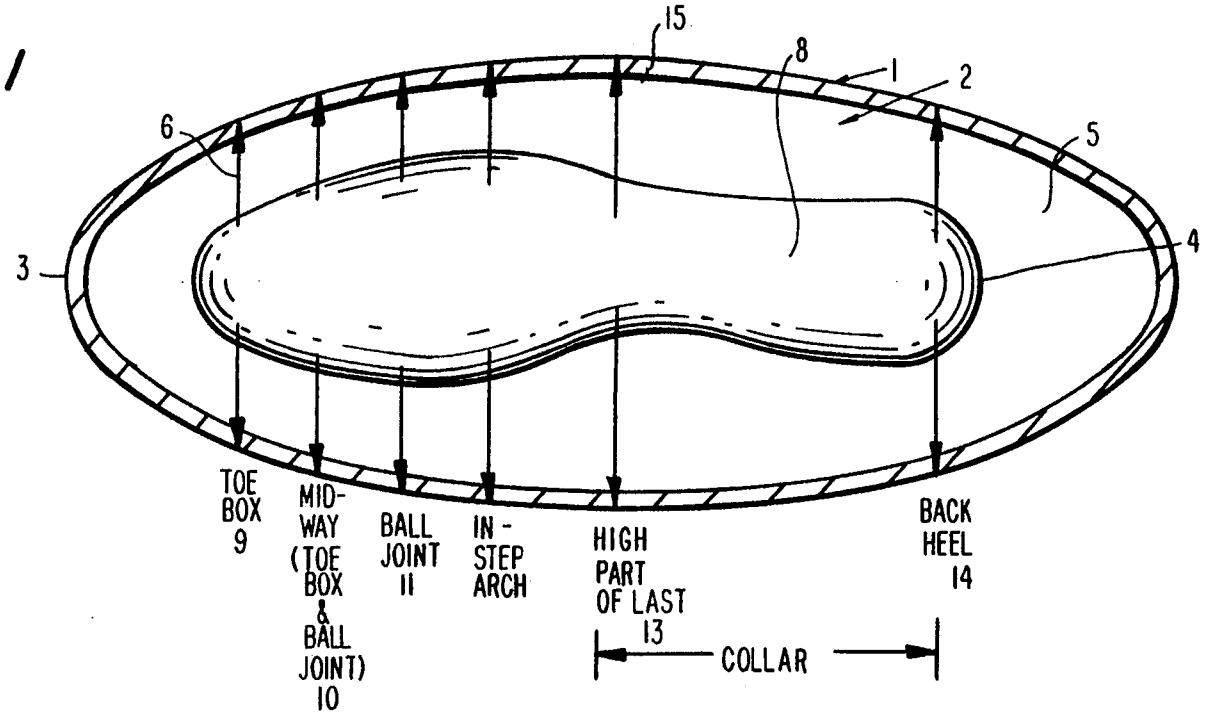
FIG. 1 is a plan view of a pattern used in making the shoe of the present invention showing the imprint of the foot outline of a one piece last and the six lines representing shoe measurements taken to make the shoe.

The present invention does not utilize a separate segments that usually comprise the shoe found in the prior art such as a toe portion, a vamp, marginal side portions etc. The shoe of the present invention is formed from a single skin , sheet or shell of flexible material on a last. Leather is the preferable material but any natural or synthetic material may be used for the upper or the liner. For the purpose of describing the invention, leather is used illustratively and not by way of limitation. FIG. 1, shows liner 1 and upper 2 to be used in forming the shoe placed atop each other before they are cut from the same measurement pattern. Alternatively, the sections can be cut separately as long as the measurements are relatively identical.

A one piece shoe last of desired size and material, preferably wood is used to form the basis and shape of the shoe. A sketch comprising the outline of the perimeter of the bottom of the shoe last around from toe 3 to heel 4 is drawn on any suitable material such as a piece of paper 5 as depicted in FIG. 1. A center line is drawn on the sketch from toe 3 to heel 4. Six measurements are taken on the shoe last and the lengths of each measurement are transcribed to the sketch using the center line 7 as the reference point. In order to have sufficient material to work with in forming the shoe, usually about ½ inch is added to the length of each of the line 6. The measurements vary between 5 and 8 inches depending on the location along the foot. Starting a small distance outside of the toe box, measurements at right angles are taken from the front toe portion back to the heel portion using the center line 7 of shoe sketch 8.

The six (6) measurements are taken on the last to be used, which are transcribed to sketch 8 using the center line 7 from toe 3 to heel 4 as the mid-way points of the measurements are generally as follows: toebox 9, toebox and ball-joint 10, ball-joint 11, instep and arch 12, high part of last 13 and heel.

Measurements 9 to 14 plus the ½ inch added on material are transcribed to sketch 8 again using the center line 7 as a midpoint. After all measurements are transcribed to the sketch, all points are connected to obtain the desired pattern 15. Pattern 15 is placed on upper material 2 and/or liner 1 and two pieces are cut either simultaneously or separately. The resulting product forms the upper and the liner to be used in making the shoes. Both the upper and liner material, both preferably leather, are dampened with luke warm water for sufficient time to make the material pliant, usually about 15, minutes with the excess water then removed. Water is suggested here but any agent that will make the material pliant can be used, e.g. oil, etc.

Figure 2:
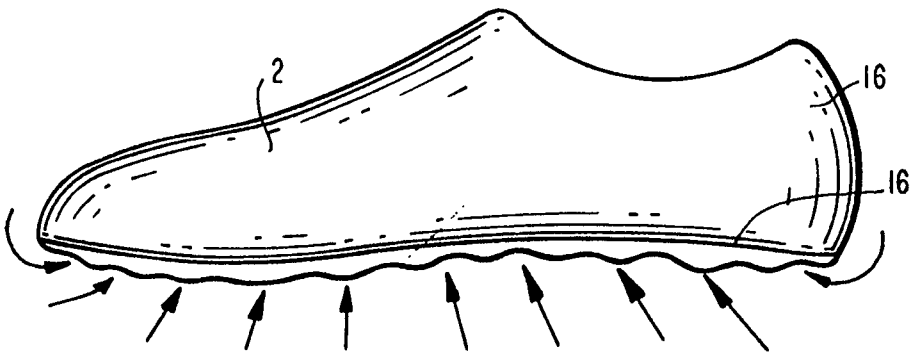
FIG. 2 is a side view of the upper material and inner liner covering a shoe last.

Referring to FIG. 2, the treated leather 2 that is to be used as the upper of the footwear is draped over last 16, and fixed at various locations (illustrated by the arrows in FIG. 2) starting at the toebox with tacks or other suitable fastening means. Any suitable procedure can be used to affix the leather upper to last 16. By way of illustration for example, it is convenient to tack on the front and across the toebox; then tack at the high part of the last under both sides of arch; tack under the back of heel while stretching gently; pulling the vamp tight and tacking, and then working out from ball of the shoe to the center of last 16.

A leather stretcher may be then applied to the back part of heel counter and it is pulled tightly on a slant and tacked every desired fraction of an inch or so. This step requires pulling away from back part of heel on alternate sides. The leather stretched over the last is observed and all adjustments required to keep leather tight and wrinkle free are made. Excess leather is trimmed at this time from bottom of last 16.

Liner 1 is processed and fabricated using the same procedure set forth above for the upper on a separate last.

Figure 3:
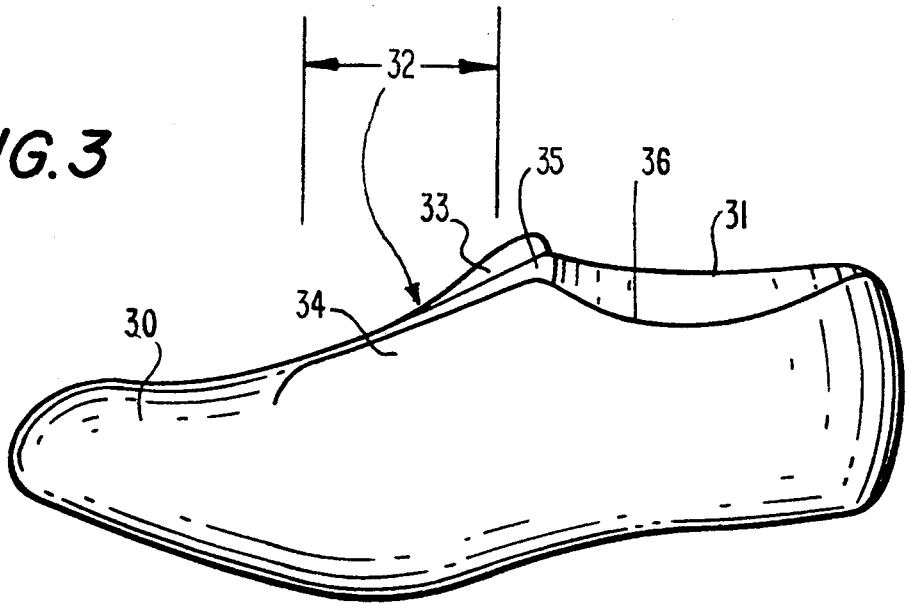
FIG. 3 is a side view of a liner covering a shoe last.

FIG. 3 depicts a liner 30 that has been secured to the last and shows the line 31 that will be cut to correspond to the configuration of the upper when the upper is placed over it. The instep 32 has two areas 33 and 34 that will form the section that will hold the eyelets for laces and 35 will form the tongue of a blucher. The area 36 bounded within line 31 will be removed to forman opening that provides access to the interior of the shoe by the foot when the shoe is finished. When the lining is dry, the back of heel maybe split and a piece of non-slip suede is glued thereon. The liner is removed from last and the suede sewn into lining. The leather is allowed to dry while remaining on last. Both liners are treated in identical fashion when a pair of shoes is made.

After the leather upper is dry so as to conform to the shape of the last, and while it is still tacked to the shoe last, the upper with a line similar to 31 in FIG. 3 is marked and cut to the style of shoe design desired, and the material cut out that forms the opening is removed. The resultant article is an upper shell which is then removed and placed over the last containing the liner. The liner is secured, preferably cemented, to interior of the leather upper shell at the side area along the collar. The desired shoe style is drawn onto the upper shell. The upper shell can be later stitched to give a wing tip effect or cap toe etc. At this point, the upper shell and liner therein are removed from the last and the lining is stitched to the upper shell and any ornamental designed is applied by stitching.

Figure 4:
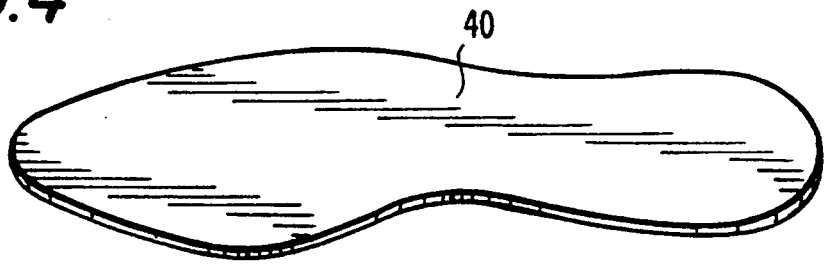
FIG. 4 is a perspective view of an insole.
Figure 5:
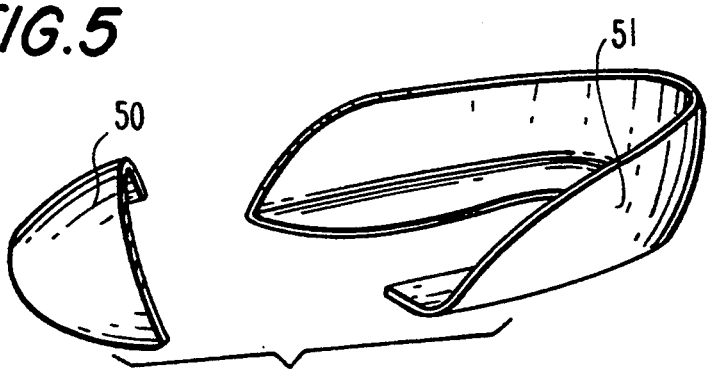
FIG. 5 is a perspective view of a toebox and counter.
Figure 6:
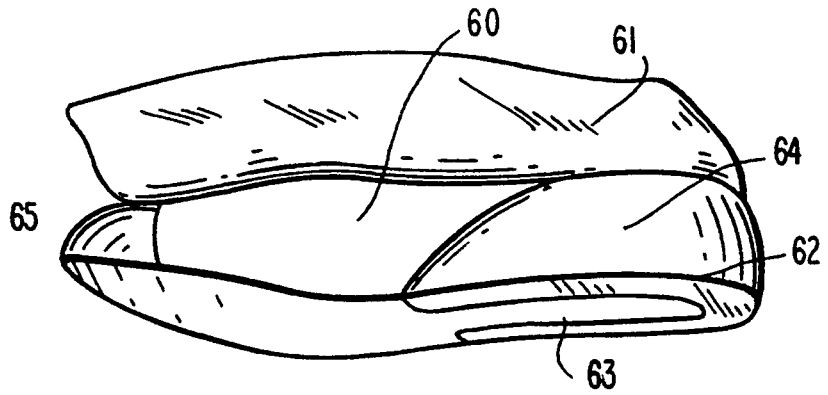
FIG. 6 is a perspective side view showing a liner secured to an upper shell.
Figure 7:
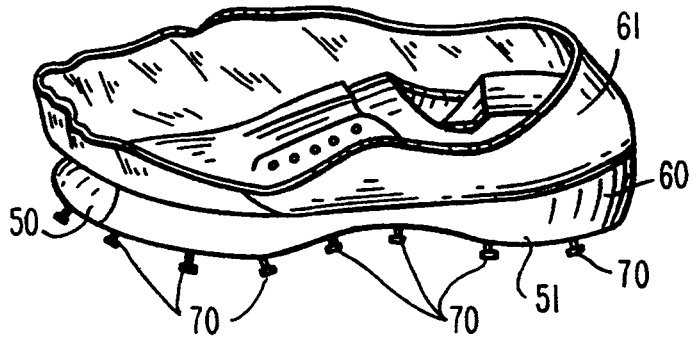
FIG. 7 is a different perspective side view of the liner and upper shell of FIG. 6.

During the process it is also necessary to make a molded leather insole for the shoes as shown in FIG. 4. The top of insole 40 is shown. It is the surface that contacts the foot of the wearer. It is also necessary to form toebox 50 and counter 51 as shown in FIG. 5. The leather insole is attached under the last and spot tacked generally in three places such as the front, the middle and the back. The upper shell and liner that has been secured thereto is placed on the last. FIG. 6 is a side view showing liner 60 secured at the top to upper shell 61 and at the bottom 62 to insole 63. Counter 64 and cap toe 65 are glued to the liner. FIG. 7 is a perspective side view showing the upper shell 61 folded up around the side of the last and liner 60 being held in place by brads or tacks 70 so as to allow the bottom edge of liner 60 to be secured by gluing etc. to the bottom of insole 63. The front, back and ball of shoe are pulled and tacked to last being careful that the front to back is generally centered on fast.

The lining by the vamp and then the arch are pulled tightly and tacked. The tacks are then removed from the leather upper. It is necessary to pull and tack the lining completely around the last and cement the lining to the insole.

Then are a series of steps involving cementing various elements comprising the shoe. For example the toebox 50 and counter 51 are cemented to the liner followed by attaching and cementing the upper shell to the toebox, lining and counter. The upper is preattached to the lining and the last by pulling and tacking and cementing the bottom of the upper to the insole leaving the tack in place.

Figure 8:
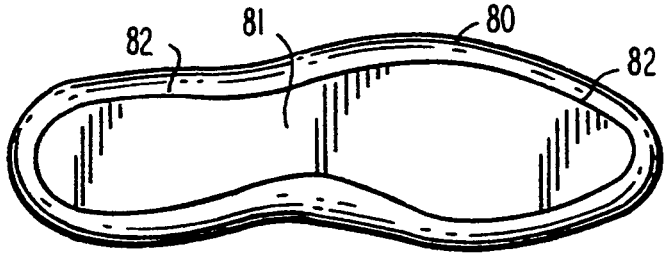
FIG. 8 is a bottom view of the intermediate article showing the upper shell secured to an insole.

Tacks are removed when the cement is dry. FIG. 8 is a bottom view of the intermediate article wherein the upper shell 80 has been secured to insole 81 at around the edge 82 of the upper shell. If desired a shank of steel or synthetic plastic having steel like properties is secured in place to provide strength to the shoe. It is applied at the rear portion of the insole and filler material is secured toward the front of the sole of the shoe.

The final step is to attach and cement the heel and sole to the shoe upper. The finished shoe is then removed from the last. The identical procedure is followed for other shoe.

As noted above, the upper and the liner are placed on separate shoe lasts. The upper is cut to the desired shape, it is then put atop the liner, cemented around the collar and stitched along the top of the collar area and at the instep for the purpose of inserting or securing a tongue. When an oxford type shoe is being constructed a separate tongue is stitched into the instep area the collar and, when an oxford is made these are the only areas of the shoe that are stitched. This tongue is not necessary when a blucher is being made.

A key feature that enables the shoes of the present invention to be formed from a single piece of material is the abrupt buildup of the slope of the shoe last in the area of same where the tongue and eyelets for laces are located on the material.

The standard shoe last possesses a gradual slope at the instep area as shown at position 1 of FIG. 9. In order to have available a suitable amount of material in the instep area to form the tongue and eyelet portion of the shoe, in accordance with the present invention, the shoe last is built up so that the excess amount of material that covers the built up portion can be used to form the tongue. The shoe last of FIG. 9 represents the foot size of the wearer so the instep of the wearer will conform to the slope when the shoe is worn.

FIG. 9 depicts a side view of a shoe last that has an upper stretched over it. As noted above, the instep slope 90 depicts the standard shoe last in the area of the shoe eyelets and tongue. The instep slope of the shoe last of the present invention is increased to correspond to broken line 91. The degree of instep slope varies depending upon whether an oxford or a blucher is to be made. The blucher with no separate tongue sewn into the shoe has the greater slope.

FIG. 10 is a perspective view of a shoe of the present invention that has been formed from the leather on the shoe last depicted in FIG. 9. The shoe 100 has shoe last 101 within it. The excess leather material resulting from the buildup of the shoe last has been cut at instep areas 102 and 103 which can receive eyelets for laces the material intermediate tongue 104. Eyelets 105 are incorporated into the two sides 102 and 103 formed.

FIG. 10A is an enlarged front view of the shoe depicted in FIG. 10 at the tongue and eyelet area of the shoe. It can be seen readily that the tongue and overlapping instep sections are formed from a single piece.

FIG. 11 is a perspective view of another embodiment of the present invention wherein the excess leather in the instep area has been subjected to a single angular cut and overlapped resulting in a casual loafer style shoe.

What I claim and desire to protect by Letters Patent is:

1. The method of forming an article of footwear comprising:

placing the identical pattern that contains the appropriate measurements on two pieces of material that are to be used respectively to form a footwear upper and the liner to be situated in the interior of said footwear, adjacent said upper;

cutting said materials to correspond to said measurements;

applying an agent to said material to render it pliable for stretching in the horizontal and vertical planes;

mounting each said material to be used as said upper, and as said liner respectively over a separate footwear shoe last, each said shoe last having top and side surfaces comprising a toe portion, a heel portion and an instep portion and a counter portion that extends on both sides of said last from the instep portion along the top of said last to said heel portion and a sole portion that comprises the bottom of said last;

stretching said material to obtain a tight wrinkle-free surface of the material on said last that it extends snugly along the top and sides of the surface of said last;

securing said material to the bottom of said last;

trimming excess material from the bottom of the last;

allowing the material to set for sufficient time to conform to the shape of said last;

forming an upper shell by cutting said upper material along the counter portion on each side and down the instep to result in the formation of a strip of material suitable for use as a tongue, wherein the two edges adjacent to said strip of material in the instep are suitable to retain eyelets for laces; removing the material cut along the counter to form an opening from instep to heel;

removing said upper shell from said last and placing it over said liner that is secured to a last;

securing said liner to said upper shell at the location of the collar;

stitching said lining to said upper shell at the edge of said opening;

cutting the lining along the edge of the upper shell and removing same so that the opening of said lining corresponds to the opening of said upper shell;

attaching a leather insole to the bottom of said last and securing the lower edge of said lining onto the bottom of said insole;

adhering a counter in the back and a toebox in the front to said lining;

adhering said upper shell to the toebox, lining and counter;

adhering the bottom edge of said upper shell to said insole;

securing a shank on the bottom of said insole toward the heel and covering the balance of the bottom of said insole with filler means;

attaching sole to the bottom of said insole and then a heel.

* * * * *